United States Patent [19]

Bagoly

[11] Patent Number: 4,584,754

[45] Date of Patent: Apr. 29, 1986

[54] INSTALLER FOR TWIST LOCK AIR FITTING

[76] Inventor: Bela A. Bagoly, 620 S. Rossmore Ave., Los Angles, Calif. 90005

[21] Appl. No.: 641,742

[22] Filed: Aug. 17, 1984

[51] Int. Cl.[4] ..... B25B 7/22

[52] U.S. Cl. ..... 29/268; 269/43

[58] Field of Search ..... 29/268, 240, 256, 263; 228/49.1, 49.3, 44.5, 48; 269/43; 285/39

[56] References Cited

U.S. PATENT DOCUMENTS

| | | | |
|---|---|---|---|
| 2,187,878 | 1/1940 | Hill et al. | 269/43 |
| 3,252,192 | 5/1966 | Smith | 228/49.2 |
| 3,400,872 | 9/1968 | Rogers | 228/44.5 |
| 3,711,920 | 1/1973 | Simmons | 269/43 |
| 3,716,079 | 2/1973 | Marshall | 269/43 |
| 4,257,135 | 3/1981 | Moebius | 29/268 |

FOREIGN PATENT DOCUMENTS

| | | | |
|---|---|---|---|
| 548824 | 11/1922 | France | 269/43 |

*Primary Examiner*—Robert C. Watson

*Attorney, Agent, or Firm*—Jerry N. Lulejian

[57] ABSTRACT

The invention is an apparatus for installing and disengaging the well-known twist lock air fitting (also known as a Chicago fitting). The invention in its narrower sense comprises two vise grips each securely attached to one of the two interlocking members of the twist lock air fitting with the two vise grips connected by an interconnecting bar attached to one vise grip with a ball joint interconnection. The twist lock air fitting is installed by pressing together and rotating the two vise grips until the claws pass the locking tabs of the fitting. Disengaging of the fitting is accomplished by a reversal of the above procedure.

2 Claims, 6 Drawing Figures

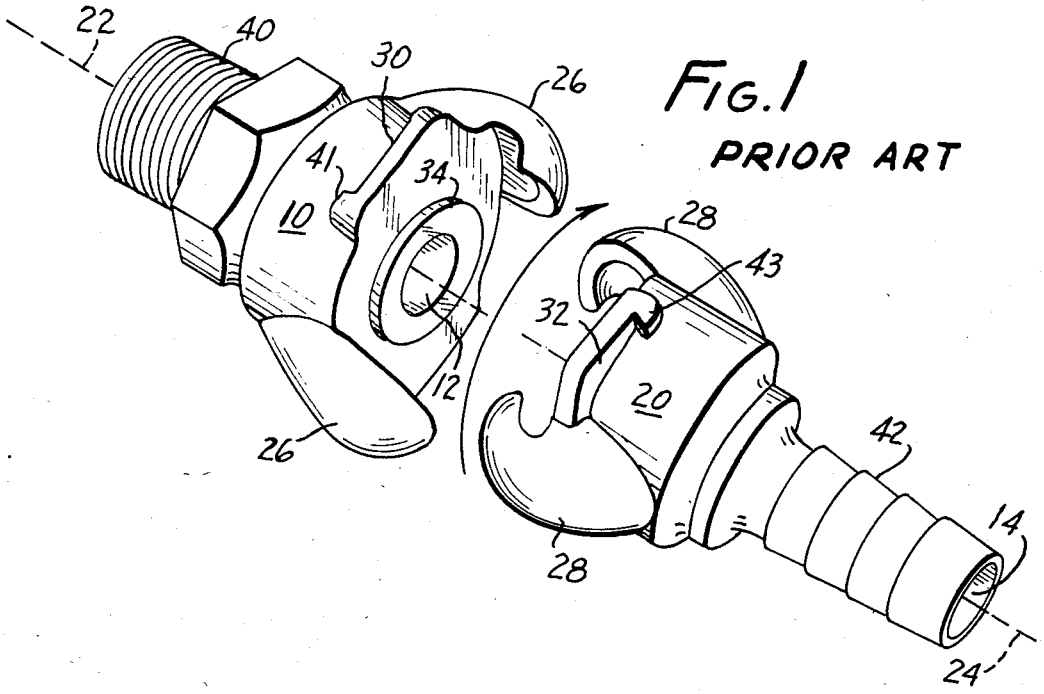
FIG. 1
PRIOR ART
FIG. 3
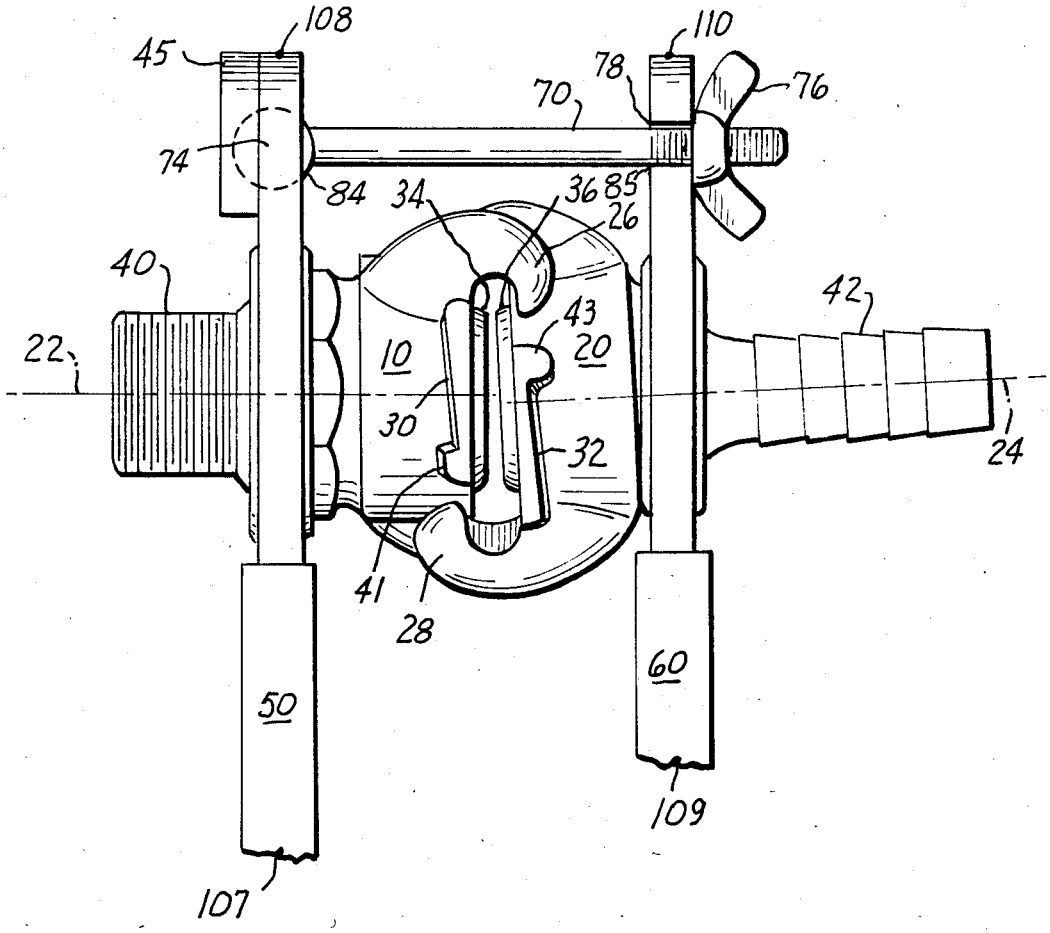

INSTALLER FOR TWIST LOCK AIR FITTING

BACKGROUND OF THE INVENTION

The present invention relates to apparatus for installing and disengaging the well-known twist lock air fitting (also known as a Chicago fitting). The twist lock air fitting has first and second interlocking members each having at least two claws to attach to locking tabs on the opposite interlocking member. The twist lock air fitting also uses grommets on each interlocking member to assure an air tight seal of the first and second interlocking members.

Of course, the whole reason for using the twist lock air fitting is to allow the installation and disengagement of the coupling at will. Nevertheless, the twist lock air fitting has, previous to the present invention, been extremely difficult to install and disengage.

The difficulty of installing and disengaging the twist lock air fitting stems from the fact that installation and disengagement require that the first and second interlocking members of the twist lock air fitting be pressed tightly together so that the sealing grommets are tightly compacted while simultaneously rotating each of the first and second interlocking members in opposite rotations about their central axes in order to allow their claws to clear the locking tabs on the locking flanges.

The prior art of installing and disengaging the twist lock air fitting known to the applicant has not been able to discover or invent an acceptable method or apparatus that will safely and conveniently install and disengage the twist lock air fitting. The only attempts of the prior art have been to attach a pair of pliers to each of the first and second interlocking members together with shaving the sealing grommets to reduce their protrusion from the first and second interlocking members and/or filing down the locking tabs to reduce or eliminate the need for simultaneous pressure between the first and second interlocking members during the opposite rotations of the first and second interlocking members. This method, at worst, creates an extremely dangerous condition where the first and second interlocking members can explosively come apart because they are not effectively locked together, or, at best, causes air or water leaks between the shaved sealing grommets. Either or both of these methods and apparatus are totally unacceptable and yet are the only methods and apparatus offered by the prior art.

The present invention offers an apparatus which enables the user to conveniently and easily create sufficient compressive force between the first and second interlocking members so that their claws can clear the locking tabs on each interlocking member together with allowing simultaneous opposite rotations of the first and second interlocking members about their central axes to complete installation or disengagement of the twist lock air fitting.

SUMMARY OF THE INVENTION

In connection with a twist lock air fitting having first and second interlocking members with each member defining a typically cylindrical passage therethrough, each passage, in turn, defining a central axis therethrough, and, each interlocking member having at least two claws thereon which interlock with locking flanges on the opposite interlocking member and each interlocking member having a sealing means to provide an airtight, high pressure interlocking between the interlocking members, an apparatus for installing and disengaging the twist lock air fitting comprising (1) a first lever means securely attachable to the first interlocking member for providing a torque force to rotate the first interlocking member about its central axis; (2) a second lever means securely attachable to the second interlocking member for providing a torque force to rotate the second interlocking member about its central axis; and, (3) a fulcrum means attachable to the first and second lever means for providing at least one fulcrum between the first and second lever means.

With the first and second interlocking members placed together, their central axes substantially colinear and their claws facing one another, with the first and second lever means securely attached to the first and second interlocking members, respectively, and with the fulcrom means attached to the first and second lever means, the installing of the first and second interlocking members of the twist lock air fitting is accomplished by providing continuous force to the first and second lever means about the at least one fulcrum provided by the fulcrum means to press together the first and second interlocking members until the claws of each pass the locking flanges on the opposite interlocking member while rotating the first and second lever means in opposite rotations about the interlocking members' central axes until the claws of the first and second interlocking members seat in their locked positions over the locking flanges on the opposite interlocking member.

The disengagement of the twist lock air fitting is accomplished by providing continuous force to the first and second lever means about the at least one fulcrum provided by the fulcrum means to press together the first and second interlocking members until the claws of each pass the locking flanges on the opposite interlocking member while rotating the first and second lever means in opposite rotations about the interlocking members' central axes (which rotations are reversals of the rotations required to install the first and second interlocking members) until the claws on the first and second interlocking members become disengaged from the locking flanges of the opposite interlocking member.

The first lever means typically comprises a first vise grip and the second lever means typically comprises a second vise grip, each of said first and second vise grips having a handle portion and a gripping portion. The fulcrum means preferably comprises (1) an interconnecting bar; (2) a means for attaching the first end of the interconnecting bar to the first vise grip; and, (3) a means for attaching the second end of the interconnecting bar to the second vise grip. The interconnecting bar acts to provide two fulcrums for the first and second vise grips.

In the preferred embodiment of the invention the fulcrums provided by the interconnecting bar are juxtaposed to the gripping portions and away from the handle portions of the installed first and second vise grips.

The means for attaching the first end of the interconnecting bar to the first vise grip preferably also includes a means for allowing the interconnecting bar to rotably tilt relative to the plane defined by the first vise grip; and, the means for attaching the second end of the interconnecting bar to the second vise grip preferably also includes a means for allowing the interconnecting bar to rotably tilt to the plane defined by the second vise grip. The means for attaching the first end of the interconnecting bar to the first vise grip and the means for allowing the interconnecting bar to rotably tilt relative to the plane defined by the first vise grip preferably comprises a ball attached to the first end of the interconnecting bar and incorporated within an area defining a socket in the first vise grip for securely receiving the ball to allow the interconnecting bar to rotably tilt relative to the plane defined by the first vise grip.

The means for attaching the second end of the interconnecting bar to the second vise grip and the means for allowing the interconnecting bar to rotably tilt relative to the plane defined by the second vise grip preferably comprises an anchor on the second end of the interconnecting bar with the second vise grip having an area defining a channel through the gripping portion of the second vise grip. The interconnecting bar fits into and through the area defining the channel in the gripping portion of the second vise grip and the anchor acts to attach and anchor the interconnecting bar to the second vise grip while allowing the interconnecting bar to rotably tilt relative to the plane defined by the second vise grip.

In an alternate embodiment of the invention the at least one fulcrum provided by the interconnecting bar is located on the side of the installed first and second interlocking members which is nearest to the handle portions and away from the gripping portions of the installed first and second vise grips.

DESCRIPTION OF THE DRAWINGS

FIG. 1 is a perspective view of the disconnected twist lock air fitting which is the subject for the present invention.

FIG. 3 is an elevational view of the preferred embodiment of the present invention installed on the subject twist lock air fitting in the suggested position before installation.

DETAILED DESCRIPTION OF THE INVENTION

Preferred Embodiment

Figure 2A:
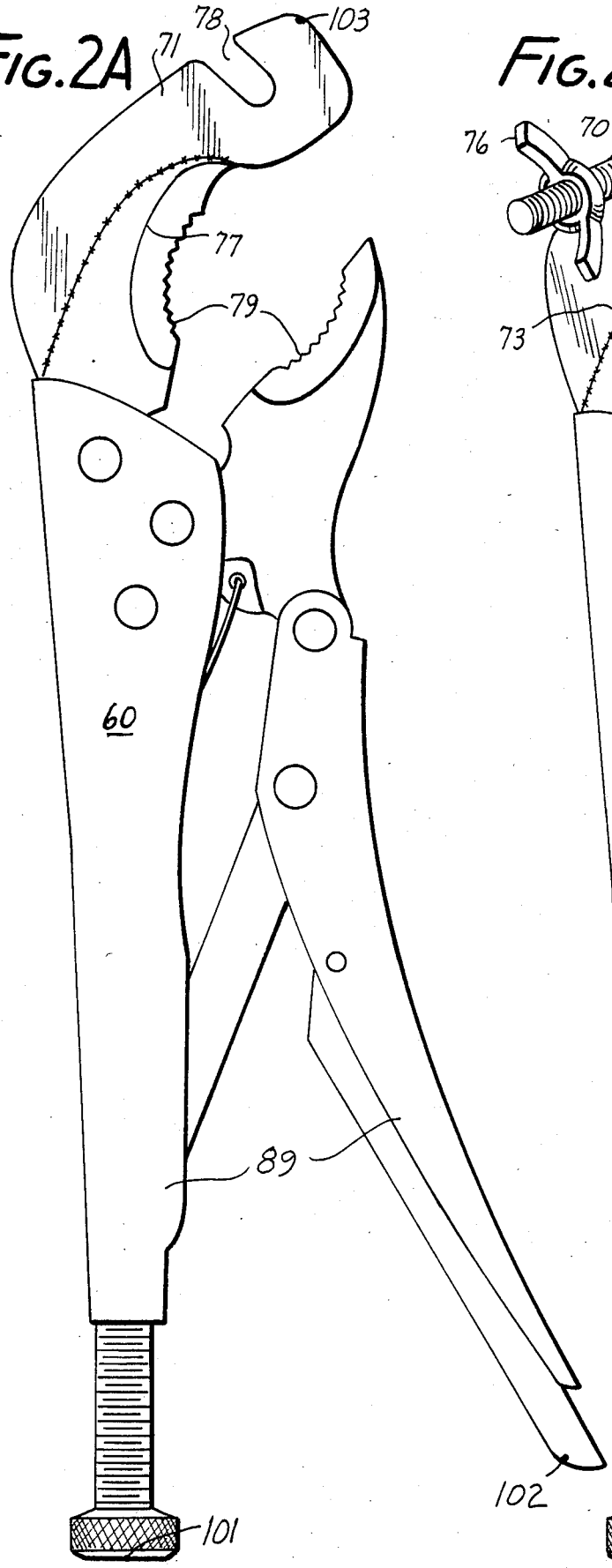
FIG. 2A is an elevational view of the modified second vise grip of the present invention.

Referring to FIG. 1, a well-known twist lock air fitting (also known as a Chicago fitting) is shown. The twist lock air fitting comprises a first interlocking member 10 and a second interlocking member 20. Each of the first and second interlocking members 10 and 20 define typically cylindrical passages 12 and 14, respectively, which are generally used to conduct high pressure air (typically 100 lbs. per square inch) or water. Each of the cylindrical passages 12 and 14 define central axes 22 and 24, respectively, which pass through the center of the cylindrical passages 12 and 14.

The first and second interlocking members 10 and 20 each have typically one pair of claws 26 and 28, respectively (although they may have four claws each), which interlock with locking flanges 32 and 30 on the opposite interlocking member. The interlocking occurs when the first and second interlocking members 10 and 20 are pressed tightly together and then rotated so that the claws 26 and 28 interlock with the locking flanges 32 and 30 on the opposite interlocking member.

The twist lock air fitting of FIG. 1 is typically provided with a sealing means to provide an airtight, high pressure interlocking between the interlocking members 10 and 20. This sealing means is typically in the form of a grommet 34 as shown on the first interlocking member 10 and grommet 36 on the second interlocking member 20 (shown only in FIGS. 3 and 5). The interlocking of the first and second interlocking members 10 and 20 presses together grommets 34 and 36 (best shown in FIG. 5) and thus provides an airtight, high pressure seal between the first and second interlocking members 10 and 20 so that air or water flows through the cylindrical passages 12 and 14 of the first and second interlocking members 10 and 20.

As shown in FIG. 1, first interlocking member 10 is equipped with a threaded portion 40 which can be interconnected with a threaded coupling which is then connected to air or water hoses (unshown). However, any coupling can be incorporated in either of the first and second interlocking members 10 and 20 to allow them to be connected to air or water hoses. For illustrative purposes only, the second interlocking member 20 is shown with a hose end 42 for direct connection to an air or water hose with the use of boss clamps (unshown).

Of course, the whole reason for using the twist lock air fitting is to allow the installation and disengagement of the coupling at will. Nevertheless, the twist lock air fitting shown in FIG. 1 has, previous to the present invention, been extremely difficult to install and disengage. The difficulty of installing and disengaging this coupling is so great that as a practical matter the coupling is installed and disengaged only as a last resort.

The difficulty of installing and disengaging the twist lock air fitting stems from the fact that installation and disengagement require that the first and second interlocking members 10 and 20 must be pressed tightly together so that the grommets 34 and 36 are tightly compacted while simultaneously rotating each of the first and second interlocking members 10 and 20 in opposite rotations about their central axes 22 and 24, respectively, in order to allow claws 26 and 28 to clear the locking tabs 43 and 41, respectively.

The prior art of installing and disengaging the twist lock air fitting known to the applicant has not been able to discover or invent an acceptable method or apparatus that will safely and conveniently install and disengage the twist lock air fitting. The only attempts of the prior art have been to attach a pair of pliers (not shown) to each of the first and second interlocking members 10 and 20 together with shaving the grommets 34 and 36 to reduce their production from the first and second interlocking members 10 and 20 and/or filing down the locking tabs 41 and 43 to reduce or eliminate the need for simultaneous pressure between the first and second interlocking members 10 and 20 during the rotations of the first and second interlocking members 10 and 20. This method, at worst, creates an extremely dangerous condition where the first and second interlocking members 10 and 20 can come explosively apart because they are not effectively locked together, or, at best, causes air or water leaks between the shaved grommets 34 and 36. Completely manual attempts at installing the twist lock air fitting are used but require the effort of at least two very strong persons working cooperatively. Either or both of these methods and apparatus are totally unacceptable and yet are the only methods and apparatus offered by the prior art.

The present invention offers an apparatus which enables the user to conveniently and easily create sufficient compressive force between the first and second interlocking members 10 and 20 so that the claws 26 and 28 can clear the locking tabs 43 and 41, respectively, together with allowing simultaneous opposite rotations of the first and second interlocking members 10 and 20 about their central axes 22 and 24, respectively.

Preferred Embodiment of the Invention

Figure 2B:
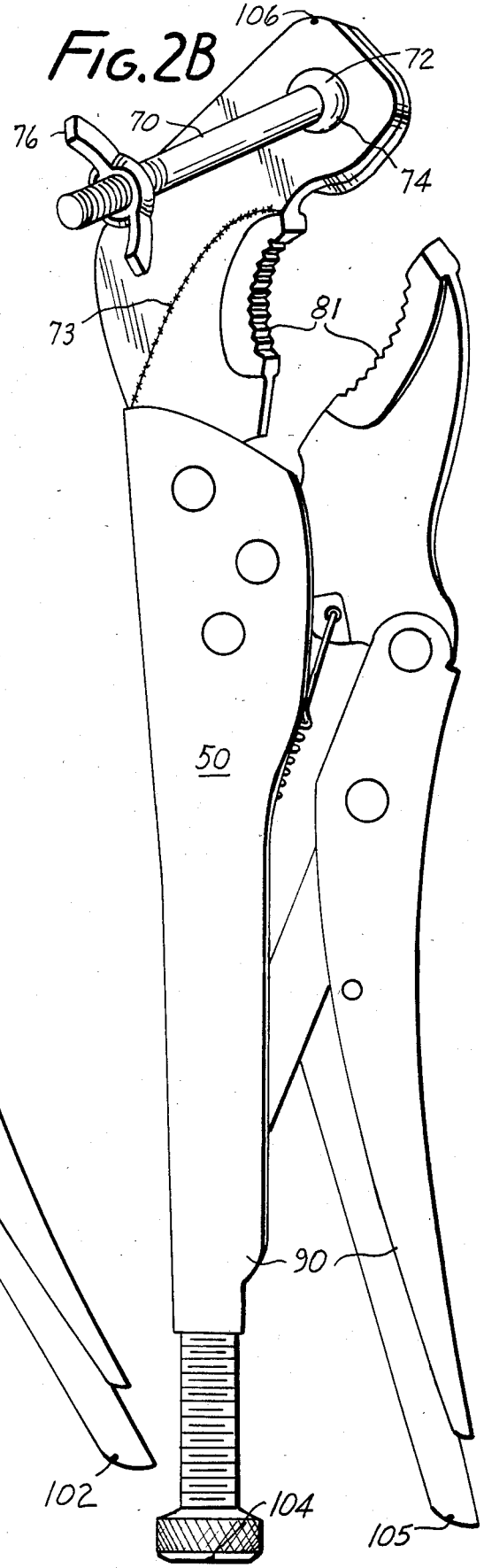
FIG. 2B is an elevational view of the modified first vise grip and the interconnecting bar of the present invention.

Referring to FIGS. 2A and 2B, the present invention is an apparatus for installing and disengaging the twist lock air fitting which comprises a first lever means securely attachable to the first interlocking member 10 (shown in FIG. 1) for providing a torque force to rotate the first interlocking member 10 about its central axis 22. This first lever means preferably comprises a first vise grip 50 as shown in FIG. 2B. The present invention also contains a second lever means securely attachable to the second interlocking member 20 (shown in FIG. 1) for providing a torque force to rotate the second interlocking member 20 about its central axis 24. This second lever means preferably comprises a second vise grip 60 as shown in FIG. 2A. Next, the present invention includes a fulcrum means attachable to and between the first and second lever means for providing at least one fulcrum between the first and second lever means. This fulcrum means preferably comprises an interconnecting bar 70, and a ball 72 attached to the first end of the interconnecting bar 70. The ball 72 is incorporated into a socket 74 formed within the first vise grip 50 and a wing nut 76 is attached to the second end of the interconnecting bar 70.

Any vise grip may be used for the first vise grip 50. Preferably the first vise grip is modified to provide the socket 74 by simply welding on to its upper gripping portion 73 an additional piece of sheet metal (of the same thickness as the metal composing the first vise grip 50) and providing a hole therein (not shown). On one side of the hole a backing 45 (shown in FIG. 3) may be used to complete the socket 74. The backing 45 preferably has a depression in it (unshown) which operates as a portion of the socket 74 to receive the ball 72. The ball 72 is interfit within the socket 74 in the first vise grip 50 so that it loosely rolls within socket 74. When the ball 72 rotates within the socket 74, the interconnecting bar 70 will tilt rotably about the plane which is defined by the first vise grip 50. The plane defined by the first vise grip 50 shall be composed of points 104, 105 and 106 (shown in FIG. 2B) and shall henceforth be referred to as simply the plane defined by the first vise grip 50.

The second vise grip 60 is preferably any vise grip which is modified by welding additional sheet metal (of a thickness similar to the thickness of the metal composing the second vise grip 60) to its upper gripping portion 77. Then a channel 78 is cut in the extended upper gripping portion 71 so that the interconnecting bar 70 fits into and through the channel 78 (best shown in FIG. 3) and the wing nut 76 acts as an anchor and attachment of the interconnecting bar 70 to the second vise grip 60. As seen best in FIG. 5, the channel 78 allows the interconnecting bar 70 to rotably tilt relative to the plane defined by the second vise grip 60 which is advantageous when the first and second vise grips 50 and 60 are rotated in opposite directions.

Referring to FIG. 2A, the plane defined by the second vise grip 60 is composed of points 101, 102 and 103 and will henceforth be referred to simply as the plane defined by the second vise grip 60.

Referring to FIG. 3, the present invention can be seen installed to the partially assembled first and second interlocking members 10 and 20. FIG. 3 shows the initial positions of the first and second interlocking members 10 and 20 as they would preferably be positioned just prior to installation. Here the central axes 22 and 24 are substantially colinear and the claws 26 and 28 are facing one another.

The first and second vise grips 50 and 60 are securely fastened to the first and second interlocking members 10 and 20, respectively. The interconnecting bar 70 is substantially perpendicular to the lines defined by the first and second vise grips 50 and 60; and, the second end of the interconnecting bar 70 is within channel 78. The wing nut 76 is tightened down so that the lines defined by the first and second vise grips 50 and 60 are substantially parallel. The line defined by the first vise grip 50 is composed of points 107 and 108. The line defined by the second vise grip is composed of points 109 and 110.

Figure 4:
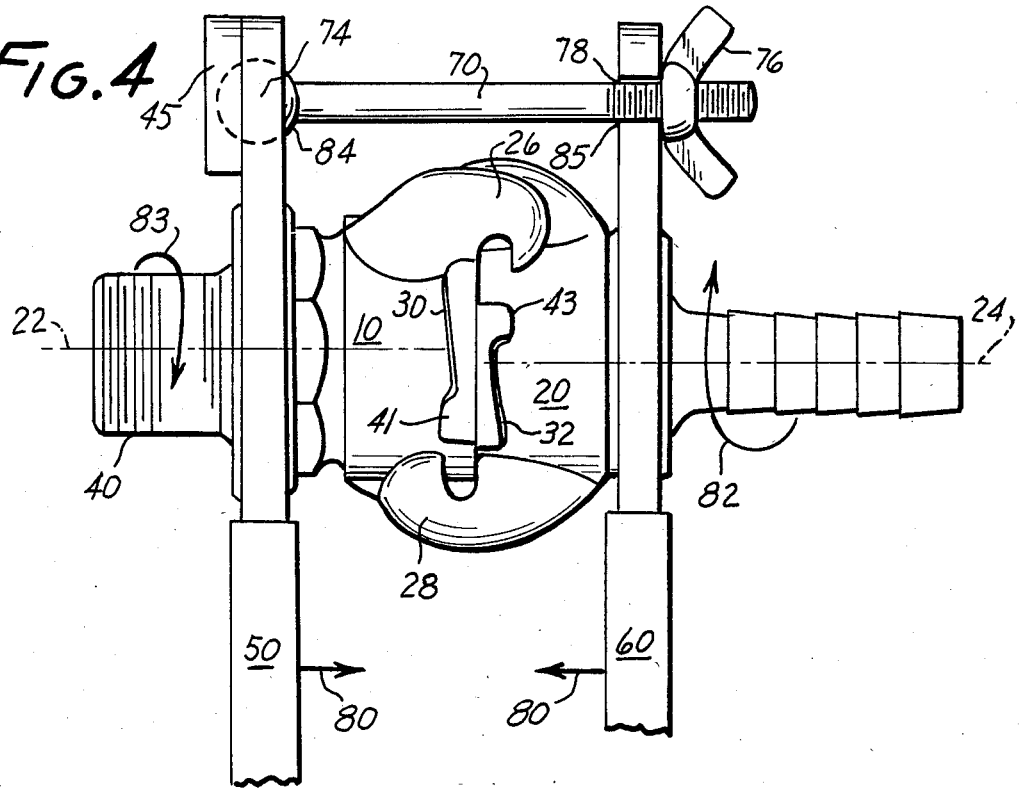
FIG. 4 is an elevational view of the preferred embodiment of the present invention installed on the subject twist lock air fitting showing the effect of the manual compressive force on the twist lock air fitting.

Referring now to FIG. 4, the installation of the first and second interlocking members 10 and 20 is accomplished first by manually applying compressive pressure between the first and second vise grips 50 and 60 (as shown in force arrows 80) to press the first and second interlocking members 10 and 20 together so that the grommets 34 and 36 are no longer visible and the bodies of the first and second interlocking members 10 and 20 are touching. As is clearly shown in FIG. 4, when such compressive force is properly applied, claws 28 and 26 will just be able to pass above locking tabs 41 and 43, respectively, if the first and second interlocking members 10 and 20 were rotated in opposite directions about their central axes 22 and 24.

While maintaining the manual compressive force indicated by force arrows 80, the user must then rotate the second vise grip 60 toward the viewer of FIG. 4 and rotate the first vise grip 50 away from the viewer of FIG. 4 as indicated in arrows 82 and 83, respectively. These opposite rotations of the first and second vise grips 50 and 60 will rotate the first and second interlocking members 10 and 20 so that claws 28 will rest on locking flanges 30 and claws 26 will rest on locking flanges 32 and the installation is complete.

Figure 5:
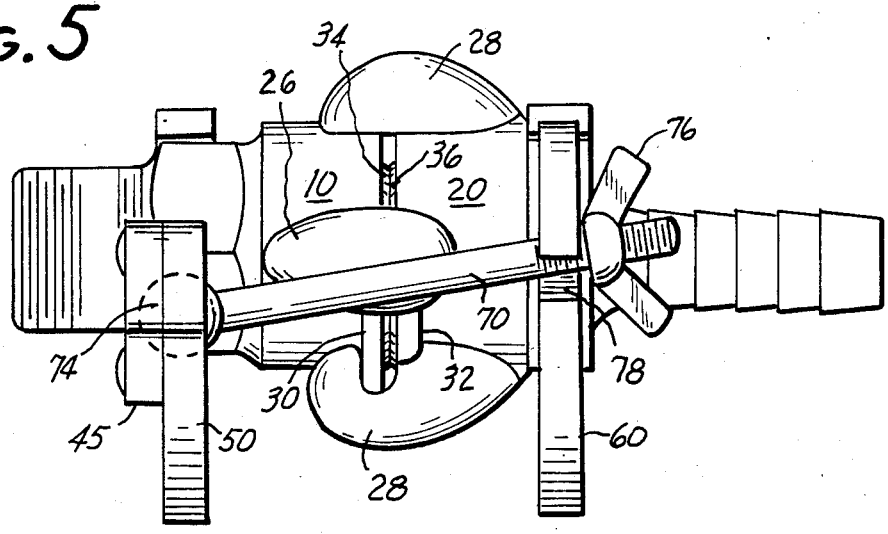
FIG. 5 is an elevational view of the preferred embodiment of the invention in its typical position just after installation of the twist lock air fitting.

Referring to FIG. 5, the position of the present invention is shown directly after installation of the first and second interlocking members 10 and 20. As can be noted, interconnecting bar 70 will preferably be able to rotably tilt relative to each of the planes defined by the first and second vise grips 50 and 60 to facilitate the opposite rotations of the first and second vise grips 50 and 60 during installation and disengagement of the first and second interlocking members 10 and 20. The first and second vise grips 50 and 60 may then be removed from the installed first and second interlocking members 10 and 20.

The disengagement of the first and second interlocking members 10 and 20 is accomplished preferably by installing the first and second vise grips 50 and 60 and the interconnecting bar 70 as shown in FIG. 5, applying the compressive force between the first and second vise grips 50 and 60 as previously indicated and shown by force arrows 80 (shown in FIG. 4) and then rotating the first and second vise grips 50 and 60 in opposite rotations than those previously described for the installation of the first and second interlocking members 10 and 20. However, it is just as effective to initially install the present invention so that the interconnecting bar 70 is substantially perpendicular to the lines defined by the first and second vise grips 50 and 60 as previously described as the proper position prior to installation.

Alternate Embodiment of the Invention

As can be clearly seen in FIG. 3, the attachment of the interconnecting bar 70 to the first and second vise grips 50 and 60 provides two fulcrums 84 and 85 enabling the user to exert the necessary compressive force which is indicated as force arrows 80 in FIG. 4. Of course, the present invention needs to provide only one fulcrum and can provide more than one fulcrum between the first and second vise grips 50 and 60. Nevertheless, the two fulcrums 84 and 85 are shown as provided juxtaposed to the gripping portions 81 and 79 (as shown in FIGS. 2A and 2B) and away from the handle portions 90 and 89 (also shown in FIGS. 2A and 2B) of the first and second vise grips 50 and 60, respectively.

Although unshown herein, the fulcrums 84 and 85 could be located on the opposite side of the first and second interlocking members 10 and 20 as is shown in FIG. 3 and could be located juxtaposed to the handle portions 90 and 89 and away from the gripping portions 81 and 79 of the first and second vise grips 50 and 60, respectively.

Under this alternative embodiment of the present invention, the interconnecting bar 70 would be the same as described in the description of the preferred embodiment except that it would preferably have balls attached to both ends which would be loosely interfit within sockets formed within the handle portions 90 and 89 of each of the first and second vise grips 50 and 60. The manual force indicated as needed to press the first and second interlocking members 10 and 20 together as shown in FIG. 4 would instead be in directions opposite of those shown in force arrows 80. The ball and sockets would allow the first and second vise grips 50 and 60 to rotate in opposite directions while maintaining the force necessary to press together the first and second interlocking members 10 and 20.

The advantage of the alternate embodiment would be that the installation and disengagement of the first and second interlocking members 10 and 20 could be begun with the simple act of attaching the first and second vise grips 50 and 60 to the first and second interlocking members 10 and 20 and then installing or disengaging them. Whereas, the preferred embodiment of the present invention must first install the first and second vise grips 50 and 60 on the first and second interlocking members 10 and 20 and then assemble the interlocking bar 70 into the channel 78 and tighten the wing nut 76 to achieve installation and must be repeated for disengagement. The disadvantage of the alternate embodiment is that the manual force to press together the first and second interlocking members 10 and 20 would be more awkward for the user unless a complicated system of levers were provided.

The preceding disclosure of the preferred and alternate embodiments of the present invention are for illustrative purposes only and shall not be considered to define the scope of the present invention. Instead the scope of the present invention shall be defined by the following claims and their equivalents.

I claim:

1. In connection with a twist lock air fitting having first and second interlocking members with each member defining a typically cylindrical passage therethrough, each passage, in turn, defining a central axis therethrough, and, each interlocking member having at least two claws thereon which pass over locking tabs and interlock with locking flanges on the opposite interlocking member and each interlocking member having a sealing means to provide an airtight, high pressure interlocking between the interlocking members, an apparatus for installing and disengaging the twist lock air fitting comprising:

a first lever operating gripping means securely attachable to the first interlocking member for providing a torque force to rotate the first interlocking member about its central axis and defining a plane;

a second lever operating gripping means securely attachable to the second interlocking member for providing a torque force to rotate the second interlocking member about its central axis and defining a plane.

an interconnecting bar having a ball attached to its first end and incorporated into an area defining a socket in the first lever operating gripping means for securely receiving the ball to allow the interconnecting bar to rotably tilt relative to the plane defined by the first lever operating gripping means;

means for attaching the second end of the interconnecting bar to the second lever operating gripping means which allows the interconnecting bar to rotably tilt relative to the plane defined by the second lever operating gripping means;

with the first and second interlocking members placed together, their central axis substantially colinear and their claws facing one another, with the first and second lever operating gripping means securely attached to the first and second interlocking members, respectively, and with the interconnecting bar attached between the first and second lever operating gripping means, the installing of the first and second interlocking members of the twist lock air fitting being accomplished by providing continuous force to the first and second lever operating gripping to press together the first and second interlocking members until the claws of each pass the locking tabs of the locking flanges on the opposite interlocking member while rotating the first and second lever operating gripping means in opposite rotations about the interlocking members' central axis until the claws of the first and second interlocking members seat in their locked positions over the locking flanges on the opposite interlocking member; and, the disengagement of the twist lock air fitting being accomplished by providing continuous force to the first and second lever operating gripping means to press together the first and second interlocking members until the claws of each pass the locking tabs of the locking flanges on the opposite interlocking member while rotating the first and second lever operating gripping means in opposite rotations about the interlocking members' central axis, which rotations are reversals of the rotations required to install the first and second interlocking members, until the claws on the first and second interlocking members become disengaged from the locking flanges of the opposite interlocking member.

2. The apparatus in accordance with claim 1 in which the means for attaching the second end of the interconnecting bar to the second lever operating gripping means comprises:

an anchor on the second end of the interconnecting bar with the second lever operating gripping means having an area defining a channel;

the interconnecting bar fitting into and through the area defining the channel in the second lever operating gripping means and the anchor acting to attach and anchor the interconnecting bar to the second lever operating gripping means while allowing the interconnecting bar to rotably tilt relative to the plane defined by the second lever operating gripping means.

* * * * *